United States Patent [19]

Berner et al.

[11] 4,375,189

[45] Mar. 1, 1983

[54] LABEL PRINTER

[75] Inventors: George J. Berner, Xenia; Robert M. Frow, Kettering, both of Ohio

[73] Assignee: Hobart Corporation, Troy, Ohio

[21] Appl. No.: 259,287

[22] Filed: Apr. 30, 1981

[51] Int. Cl.[3] ..... B41L 45/00

[52] U.S. Cl. ..... 101/68; 101/288; 225/100; 226/195

[58] Field of Search ..... 101/66-69, 101/287-292, 93.19, 316; 225/100, 106; 226/176, 195; 156/189, 384

[56] References Cited

U.S. PATENT DOCUMENTS

| | | | |
|---|---|---|---|
| 2,824,736 | 2/1958 | Allen | 271/2.6 |
| 2,948,465 | 8/1960 | Allen | 235/58 |
| 3,021,988 | 2/1962 | Focht | 266/58 |
| 3,104,806 | 9/1963 | Allen | 235/58 |
| 3,417,681 | 12/1968 | Lemelson | 101/288 X |
| 3,447,992 | 6/1969 | Allen et al. | 156/361 |
| 3,556,898 | 1/1971 | Allen | 156/384 |
| 3,674,614 | 7/1972 | Templeton | 161/39 |
| 3,730,411 | 5/1973 | Brockruiler | 225/100 |
| 3,823,665 | 7/1974 | Davis et al. | 101/66 |
| 3,951,061 | 4/1976 | Bremaer et al. | 101/288 X |
| 3,987,949 | 10/1976 | Manning | 225/106 |
| 3,989,929 | 11/1976 | Treiber | 235/61.9 |
| 4,057,015 | 11/1977 | Kodis | 101/93.29 |
| 4,077,137 | 3/1978 | Edgington et al. | 226/195 X |
| 4,094,244 | 6/1978 | Edwards et al. | 101/66 |
| 4,131,272 | 12/1978 | Hartnig | 225/100 X |
| 4,153,918 | 5/1979 | Jenkins | 226/195 X |
| 4,240,854 | 12/1980 | Massey et al. | 156/157 |
| 4,284,221 | 8/1981 | Nagel et al. | 225/100 |

OTHER PUBLICATIONS

Bowman et al., IBM Tech. Discl. Bulletin, vol. 20, No. 9, Feb. 1978, pp. 3622-3623.

*Primary Examiner*—Edward M. Coven

*Attorney, Agent, or Firm*—Biebel, French & Nauman

[57] ABSTRACT

A label printer for printing both human readable and machine readable indicia on the end label in a strip of perforated label stock includes a drum printer providing printing at a print station and label advancing rollers for advancing the label stock from a supply through the print station. Human readable indicia are printed on the end label during this advancement. Label tensioning rollers are provided on the opposite side of the print station from the label advancing rollers and engage the end label after a portion of the label has been transported past the print station. When the label tensioning rollers have engaged the end label, the machine readable indicia are printed on the label, as well as any additional human readable indica. The label tensioning rollers provide for tensioning of the label during printing of the machine readable indicia so as to enhance the resolution of the printed indicia. A label bursting arrangement is provided which includes label bursting rollers between the label tensioning rollers and a label output.

15 Claims, 10 Drawing Figures

LABEL PRINTER

BACKGROUND OF THE INVENTION

The present invention relates to a label printer of the type used to print both human readable and machine readable indicia on labels from a strip of label stock and, more particularly, to such a printer in which the label stock has laterally extending perforation lines spaced along its length which define the individual labels and in which the leading label in the strip is printed and subsequently burst along the perforation line between it and the next label in the strip.

The printer of the present invention is particularly suited for weighing and labeling systems of the type used in supermarkets and grocery stores for determining the weight and total value of a random weight packaged item, printing a label including this information, and applying the label to the packaged item. Such a label may typically include machine readable bar code indicia, such as the Universal Product Code, specifying the type of product and the total cost of the labeled package, as well as human readable indicia specifying this information. Additional information such as weight, price per unit weight, and shelf life, may also be printed on the label in human readable indicia.

Each of a series of packages may be weighed and labeled automatically, as shown in Treiber U.S. Pat. No. 3,989,929, issued Nov. 2, 1976, and assigned to the assignee of the present invention. The Treiber patent discloses an arrangement by which a first human readable label is printed by one printer, and a second bar code label is printed by a second printer. The labels are then applied in succession to the top and bottom surfaces of a package. It will be appreciated, however, that it may be desirable to label packages with labels including both machine readable and human readable indicia.

Such labels may, for example, be printed on label stock consisting of a strip of release material carrying a plurality of labels mounted on the release material by a pressure sensitive adhesive. After printing labels of this type, they may be peeled from the strip of release material and applied to the packages. Although advantageous in certain respect, the use of pressure sensitive adhesive backed label stock is relatively expensive, and the labels are somewhat difficult to handle after being removed from the release material. Additionally, the web of release material takes up a substantial portion of the label stock supply space in the printer and, further, must be disposed of in some manner after the labels are printed and removed.

Other printers, such as shown for example in U.S. Pat. No. 3,104,806, issued Sept. 24, 1963, to Allen, and assigned to the assignee of the present invention, have utilized a strip of label stock having a heat activated adhesive coating which is softened by a heater in the printer output chute just prior to applying the labels to the packages. Heat activated adhesive backed label stock is advantageous in that no release material is required to support the labels during printing. Further, since the adhesive is not activated by heating until just prior to application of the labels, special label handling arrangements required with adhesive backed labels are unnecessary.

One difficulty, however, in printing on heat activated adhesive backed label stock and, indeed, upon any label stock not having a strip of backing material, is that printing typically must be accomplished on the label at the very forward end of the strip of label stock. If it is desired to print very close to the edge of the label, it may be difficult to engage the label on both sides of the printing station so as to hold it taut during printing.

In the printer disclosed in the Allen '806 patent printing is accomplished both prior to the detachment of the leading label from the label stock at a cutting station, and subsequent to the detachment of the leading label. It will be appreciated that while the label stock is not held on both sides of the print station during printing, nevertheless, the print quality of the human readable indicia produced by the Allen printer is acceptable. Although high resolution printing of human readable indicia is desirable, it is not critical so long as the printed indicia are legible. The resolution of printed machine readable indicia tends to be somewhat more important, however, since the printed bars must be well defined and accurately positioned for reliable reading by an optical reader system.

U.S. Pat. No. 4,057,015, issued Nov. 8, 1977, to Kodis, discloses a ticket printing system having a rotatable print drum with rows of raised printing elements disposed about its periphery. A print hammer assembly cooperates with each column of printing elements for printing indicia on a paper web advanced between the rotating drum and the hammer assembly. The web is pressed against specific printing elements by individual hammers. The Kodis system prints both bar codes and human readable indicia and the patent disclosure recognizes the need for high resolution. The Kodis printer prints both bar codes and human readable indicia on each ticket portion of the web prior to separation of that portion from the web and with the leading edge of the web being unsupported. An attempt is made to improve resolution in the Kodis printer by inking the print drum heavily. While this may produce bar codes which are of sufficient contrast, nevertheless, the bars may be slightly misplaced on the tickets since the tickets are supported only along their trailing edges during printing. In reading UPC characters, it is extremely important to provide accurate spacing between successive bar characters in order for the code information to be read successfully by machine.

A further problem which is encountered with printers of the type shown in the Kodis '015 and Allen '806 patents is that of separating the leading label or ticket from the balance of the label stock or paper web. Quite typically, as shown in both of these patents, a cutter arrangement is provided to detach the printed label or ticket from the unprinted stock or web. Such arrangements add appreciably to the complexity and cost of the printers. Additionally, cutting successive labels from the label stock produces paper dust which may contaminate various printer elements and require frequent cleaning.

Accordingly, it is seen that there is a need for a printing device capable of high resolution printing of both human readable indicia and machine readable indicia on the leading label in a strip of label stock, and for such a device in which the leading label may be separated from the strip of label stock subsequent to printing without unduly complicating the printer.

SUMMARY OF THE INVENTION

A label printer for printing both human readable and machine readable indicia on the end label in a strip of perforated label stock, includes printer means, positioned at a print station, for printing both human readable and machine readable indicia on a label transported past the print station. A supply means provides a strip of label stock having laterally extending perforation lines spaced along the strip so as to define a plurality of labels. Label advancing rollers are provided between the supply means and the print station for engaging opposite sides of the label stock and for advancing the label stock through the print station to permit printing on the end label thereof. Only human readable indicia are printed on the end label during advancement of the end label past the print station by a predetermined distance. Label tensioning rollers are positioned on the opposite side of the print station from the label advancing rollers are engaging opposite sides of the end label as the label is transported past the print station. The label tensioning rollers are positioned a distance from the print station equal to or less than the predetermined distance. As a result, the label stock is engaged by both the label advancing rollers and the label tensioning rollers during printing of the machine readable indicia on the end label. A roller drive means is connected to both the label advancing rollers and the label tensioning rollers and rotates these rollers in synchronization.

The roller drive means may comprise means for rotating the label advancing rollers and the label tensioning rollers at substantially the same rotational velocity. The radius of the label tensioning rollers may be greater than the radius of the label advancing rollers, whereby the end label is held in tension during printing of the machine readable indicia.

The printer may further include means defining a label output path for removing printed labels from the printer to a label output, and label stock bursting rollers, positioned between the label output and the label tensioning rollers, for bursting the end label from the strip of label stock. The bursting rollers may include idler rollers on one side of the strip of label stock and noncircular rollers on the other side of the strip of label stock. The noncircular rollers are mounted such that a label is is engaged between the idler rollers and the noncircular rollers only during a portion of a rotation of the noncircular rollers. The label printer further includes a gripping member positioned adjacent the label output path on one side thereof and a cooperating roller on the opposite side of the label output path. The printer includes means for moving the gripping member to grip the label adjacent the end label in the central portion thereof between the member and the cooperating roller during bursting of the end label from the strip of label stock.

Accordingly, it is an object of the present invention to provide a label printer for printing both human readable and machine readable indicia on the end label in a strip of perforated label stock in which label advancing rollers and label tensioning rollers are provided on opposite sides of a print station, and in which each label is engaged by both the label advancing rollers and the label tensioning rollers prior to printing the machine readable indicia thereon; to provide such a printer in which a roller drive means provides for rotation of the label advancing rollers and the label tensioning rollers at substantially the same rotational velocity, but in which the radius of the label tensioning rollers is greater than the radius of the label advancing rollers, whereby the end label is held in tension during printing of the machine readable indicia thereon; to provide such a printer in which bursting rollers are also provided adjacent a label output path for removing printed labels from the printer to a label output; to provide such a printer in which the bursting rollers comprise idler rollers on one side of the strip of label stock and noncircular rollers on the other side of the strip of label stock; and to provide such a printer in which a gripping member is positioned adjacent the label output path on one side thereof and a cooperating roller is positioned on the opposite side of the label output path with means being provided for moving the gripping member so as to grip the label adjacent the end label in the central portion thereof between the member and the cooperating roller during bursting of the end label from the strip of label stock.

Other objects and advantages of the invention will be apparent from the following description, the accompanying drawings and the appended claims.

DETAILED DESCRIPTION OF THE PREFERRED EMBODIMENT

Figure 2:
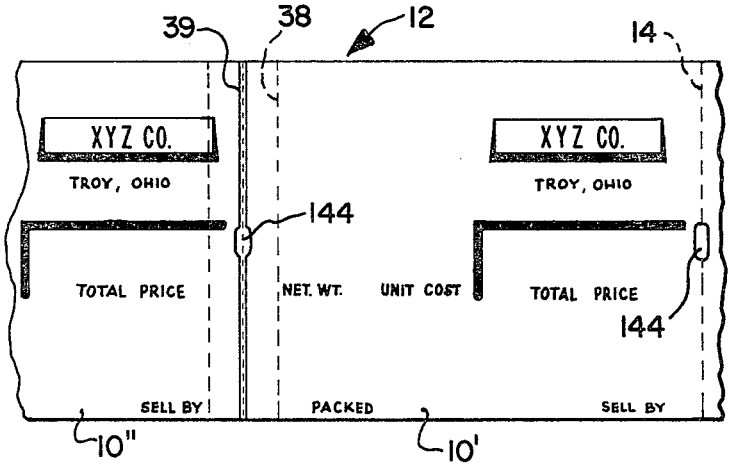
FIG. 2 is a plan view, illustrating a splice between two strips of unprinted label stock.
Figure 1:
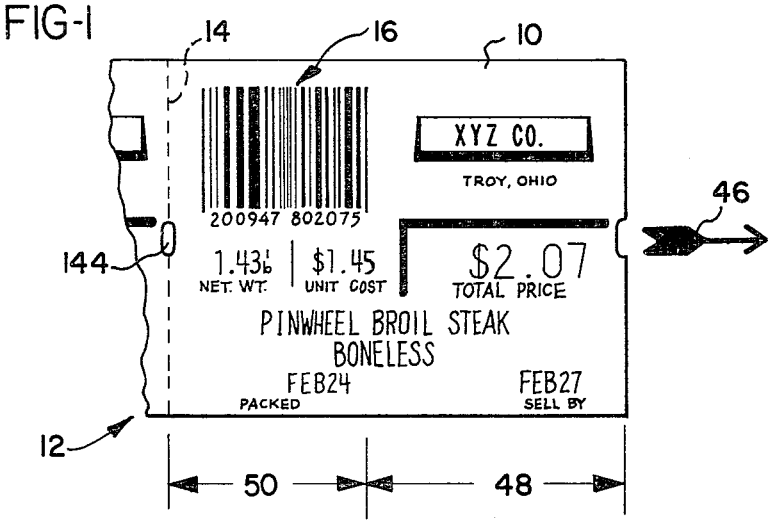
FIG. 1 is a plan view of a label of the type printed by the printer of the present invention, bearing both human readable indicia and machine readable indicia.

The present invention relates to a label printer and, more particularly, to a printer of the type which prints both human readable indicia, such as alphanumeric characters, and machine readable indicia, such as a bar code, on labels supplied from a strip of label stock having laterally extending perforation lines spaced along the strip so as to define the labels. FIG. 1 illustrates the leading label 10 in a strip of label stock 12 after the label is printed. In contrast, FIG. 2 illustrates a strip of label stock 12 prior to printing and separation of the labels from the stock along perforation lines 14. It will be noted that the strip of label stock 12 may include a number of preprinted headings which are useful in interpreting subsequently printed human readable indicia.

The present invention may advantageously be incorporated into an automatic weighing and labeling system of the kind utilized in grocery stores and supermarkets to weigh and label produce, meats, and other items which are packaged in the store. As shown in the above referenced U.S. Pat. No. 3,878,909, issued Apr. 22, 1975, to Treiber, a wrapped package may be automatically conveyed to or, alternatively, manually placed on a scale which determines the weight of the package. This weight information is then supplied to a computer which computes the total price of the package, based upon previously entered price per unit weight information.

The computer then supplies the printer with control signals specifying the measured weight, the computed total price, and the unit cost, along with control signals specifying the name of the packaged item, the date upon which it was packed, and shelf life information. Control signals relating to the product and total price are also provided for controlling printing of the bar code information on the label. As shown in FIG. 1, the packed "PINWHEEL BROIL STEAK BONELESS" meat weighs 1.43 lbs. and, at a unit cost of $1.45 per pound, has a total price of $2.07. The meat was packed on Feb. 24, and the shelf life is three days. In addition to this human readable information printed on label 10, bar code indicia 16 are also printed on the label. This code may for example be in the machine readable Universal Product Code (UPC) format. The printed bar code identifies the UPC number system selected, the commodity being sold, the value of the package, and includes a parity number used by the reading system to validate the reading operation.

Figure 3:
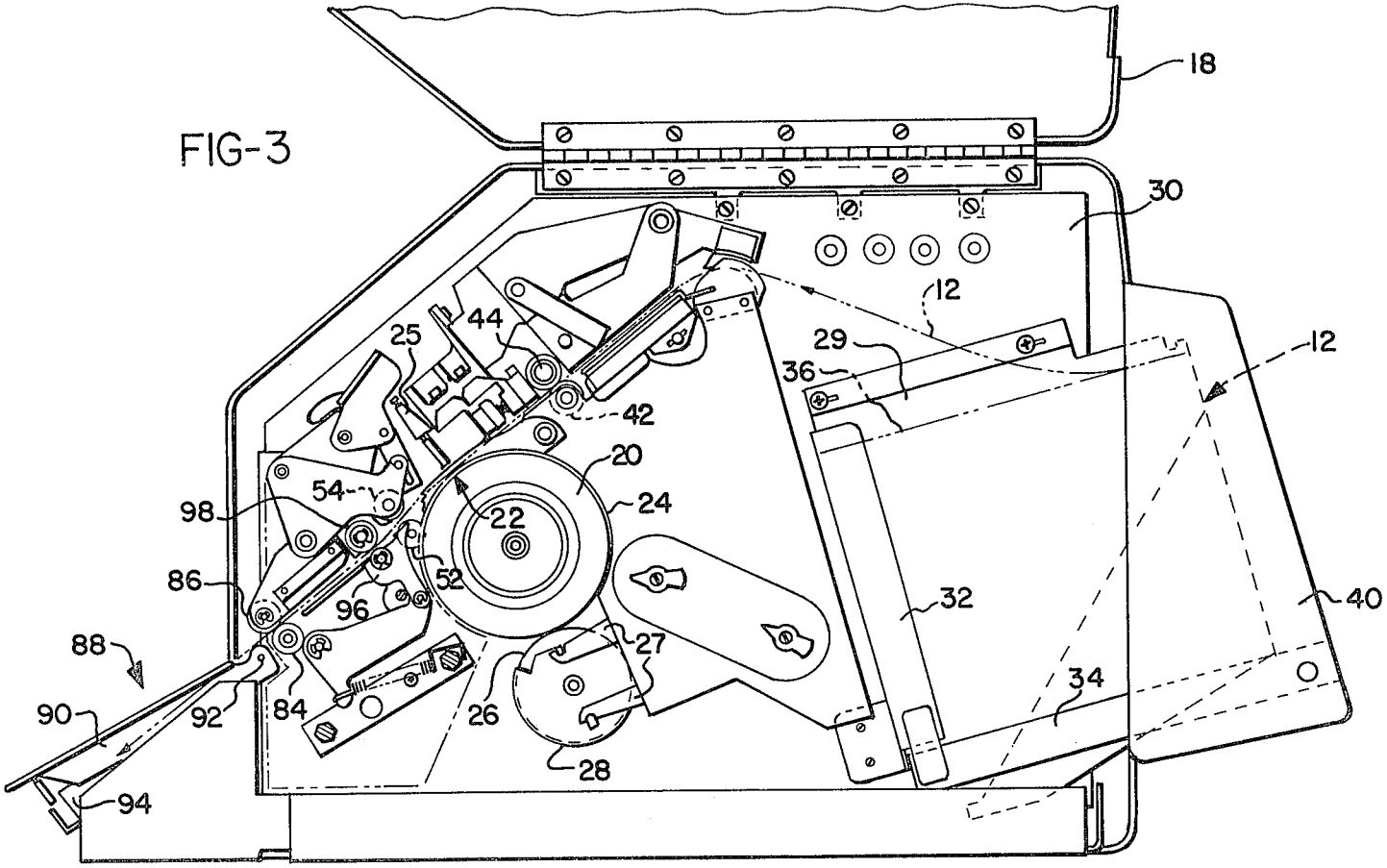
FIG. 3 is a side elevational view of a printer constructed according to the present invention.

FIG. 3 is a side elevational view of the label printer with the hinged portion 18 of the printer cabinet raised to reveal the internal printer elements. A printer means, including a rotatable print drum 20, is provided for printing both the human readable indicia and the machine readable indicia on label stock 12 at print station 22. Print drum 20 is continuously rotated and defines raised printing elements which are disposed about its peripheral surface 24 in arcuate columns. A label to be printed is indexed past print station 22 between the drum 20 and a plurality of print hammers 25. Each print hammer includes an electromagnetic actuation device which, when electrically energized, causes the hammer to move toward drum 20.

The surface 24 of the drum 20 is coated with ink by means of an ink impregnated roller 26 held against surface 24 by support arms 27 which engage roller cover 28. Roller 26 may be made of a porous rubber material which is impregnated with ink. Ink roller 26 freely rotates in contact with drum 20 and continuously inks peripheral surface 24 of the drum. When the ink in roller 26 is depleted, the roller 26 is discarded and replaced by a fresh roller.

Print hammers 25 are arranged in a row normal to the plane of FIG. 3, with each hammer being associated with a corresponding arcuate column of print elements on the peripheral surface 24 of drum 20. An encoder arrangement, such as an optical encoder, monitors the rotational position of drum 20 and, when a desired print element in one of the columns on surface 24 is properly aligned at print station 22, the corresponding print hammer is electrically actuated, and presses the label against the inked print element at print station 22, resulting in printing of the desired indicia on the label.

The printer further comprises a supply means, including label supporting rack 29 mounted on main support wall 30. Rack 29 includes a front label support flange 32 and a bottom rack portion 34 which support a fan-folded stack 36 of label stock 12. Label stock 12 is folded at every third perforation line, for example, in a zig-zag fold arrangement such that the label stock 12 may be withdrawn from the top of the stack 36 until the entire stack is depleted.

If desired, the trailing end of the strip of label stock making up stack 36 may be connected to the leading end of a second stack of label stock by means of a splice 38, as shown in FIG. 2, attached to the back side of the label stock. Splice 38 may conveniently comprise a piece of transparent adhesive backed tape having a perforation line 39 along its length so as to permit separation of label 10′ from trailing label 10″ in the same manner that the labels within a strip are separated from the strip of label stock subsequent to printing. If desired, rear cover portion 40 may be pivoted rearwardly to provide an additional support surface for supporting a second stack of label stock which is spliced to the trailing end of stack 36.

As seen in FIG. 3, the label printer further includes label advancing rollers 42 and 44 which are positioned between the supply means and the print station 22, and which engage opposite sides of the label stock 12. When rotated, the label advancing rollers 42 and 44 advance the label stock 12 through the print station 22 to permit printing along the length of the leading label in the strip. Label 10 on strip 12 is advanced through the print station 22 in the direction of arrow 46, as shown in FIG. 1. During the movement of the first portion 48 past the print station 22, only human readable indicia are printed on the end label 10. Only after the label has moved past the print station 22 by a predetermined distance equal to the length of portion 48 are the bar code indicia 16 printed. Human readable indicia in the trailing portion 50 of the label 10 are printed simultaneously with printing of indicia 16.

Label tensioning rollers 52 and 54 are positioned on the opposite side of the print station 22 from the label advancing rollers 42 and 44. Label tensioning rollers 52 and 54 engage the end label in the strip 12. The label tensioning rollers 52 and 54 are positioned a distance from the print station equal to or less than the predetermined distance, corresponding to the length of label portion 48, and as a consequence, the label 10 is engaged by the label tensioning rollers during printing of the machine readable indicia 16 on the end label. As explained more fully below, the label tensioning rollers 52 and 54 are rotated such that their tangential velocity is slightly greater than that of the label advancing rollers 42 and 44. As a result, the end label 10 is held taut during printing of the bar code 16 as the second portion 50 of the label 10 is transported past the print station 22. By holding the label on both sides of the print station 22 and maintaining the label under a slight tension, the position of the label with respect to print station 22 is precisely controlled and the bar code indicia printed on the label are properly positioned and spaced. As mentioned previously, accurately printed indicia greatly increase the likelihood of successful machine reading of the label.

Figure 4:
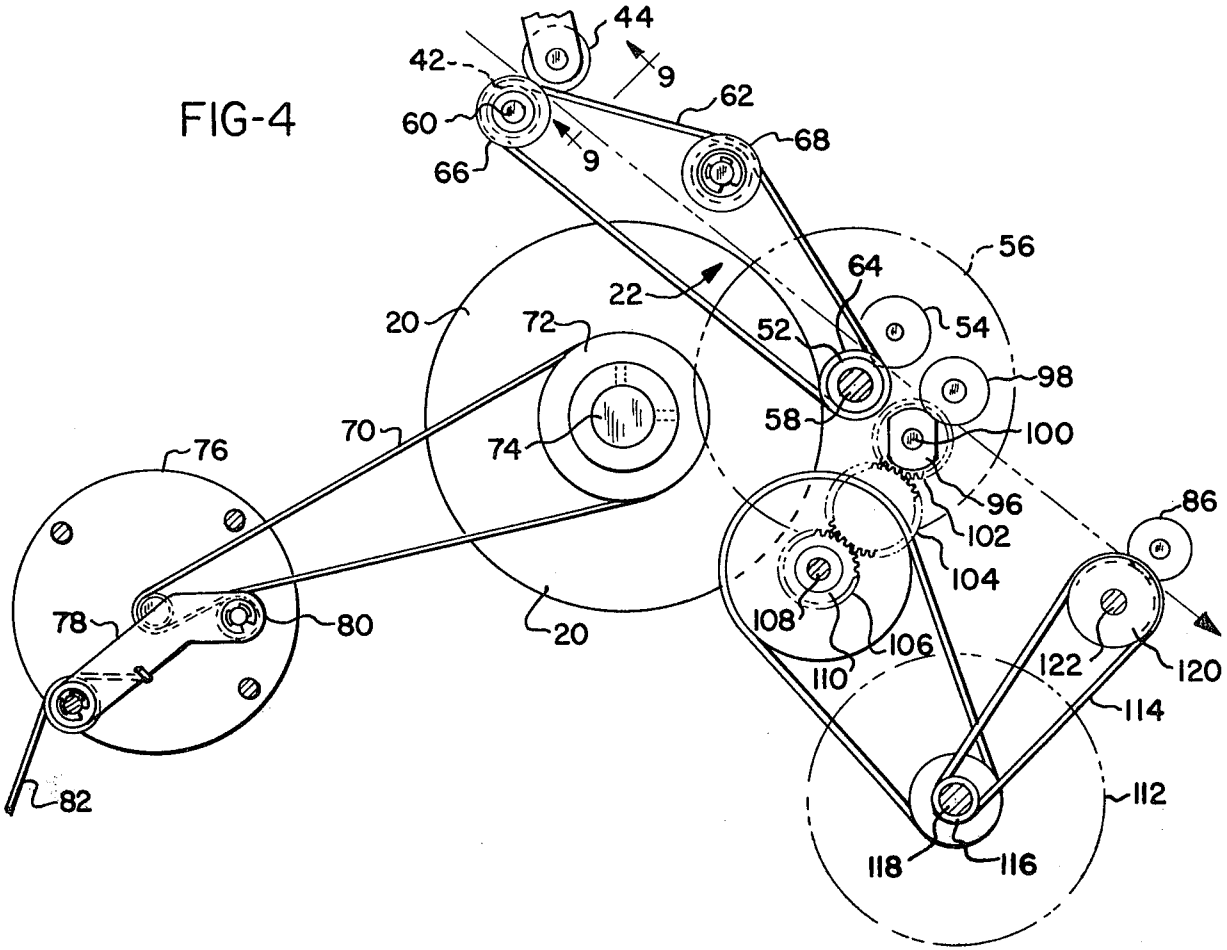
FIG. 4 is a side view of the drive mechanism of the printer, as seen from the side opposite that from which FIG. 3 was taken.

As seen in FIG. 4, the printer includes a roller drive means including a drive motor 56 coupled directly to shaft 58 upon which label tensioning rollers 52 are mounted. The label tensioning rollers 54 are mounted for free rotation in contact with rollers 52. Motor 56 also is connected to shaft 60 upon which rollers 42 are mounted by means of a timing belt 62 extending between pulleys 64 and 66 and also extending around idler pulley 68. Motor 56 is preferably a stepping motor which is actuated to move the labels 10 past the print station 22 in an incremental fashion, with each increment of movement being effected after printing all of the desired indicia on the label at the portion of the label aligned with the printing station.

Also illustrated in FIG. 4 is the pulley drive arrangement by which drum 20 is driven. Belt 70 extends between pulley 72, mounted on drum shaft 74, and motor 76 which is driven continuously at a substantially constant speed. A belt tensioning arm assembly 78 is mounted on motor 76 and includes a tensioning roller 80 which is urged into contact with belt 70 by spring 82 such that the desired tension is maintained in belt 70.

Pulleys 64 and 66 are substantially the same in size such that the label advancing rollers 42 and 44 and the label tensioning rollers 52 and 54 are rotated at substantially the same rotational rate. The radius of label tensioning roller 52, however, is slightly greater than the radius of label advancing roller 42. The tangential velocity of rollers 52 and 54 is therefore greater than the tangential velocity of rollers 42 and 44.

Rollers 52 and 54 are urged together with a force greater than that which urges rollers 42 and 44 together. As a result, each label is securely frictionally engaged between rollers 52 and 54, while a small amount of slippage occurs between the label and roller 42 during printing of label portion 50. Each label is thereby held taut as the machine readable bar code indicia are printed, resulting in a higher resolution printing of this portion of the label and a corresponding increase in machine readability.

After a label is engaged by rollers 52 and 54, its movement is controlled by these rollers. It is important to note that these rollers are mounted on shaft 58 which is directly coupled to driving motor 56. As a result, rotation of motor 56 moves the label by precise increments. Rotational inaccuracies of rollers 42 produced by the belt drive do not affect the position of the label since slippage occurs between these rollers and the label in any event. The tension in the portion of the strip of label stock between rollers 42 and 44, and rollers 52 and 54 is maintained at a level less than that which could cause the strip to tear along a perforation line 14.

After the leading end label in the strip of label stock is printed, it is necessary to separate the label from the remainder of the strip of label stock and to convey it along a label output path. For this purpose, a pair of continuously rotating discharge rollers 84 and 86 are provided which deliver each label 10 to a label output 88. A label retainer 90 is pivotally mounted at 92 and may be moved downward so as to permit a package pressed against output 88 to receive a label held within the retainer 90 and resting on heater 94. Heater 94 heats each label delivered to output 88 so as to soften heat sensitive adhesive coating on the upper surface of the label in preparation for application of the label to a package.

Figure 6:
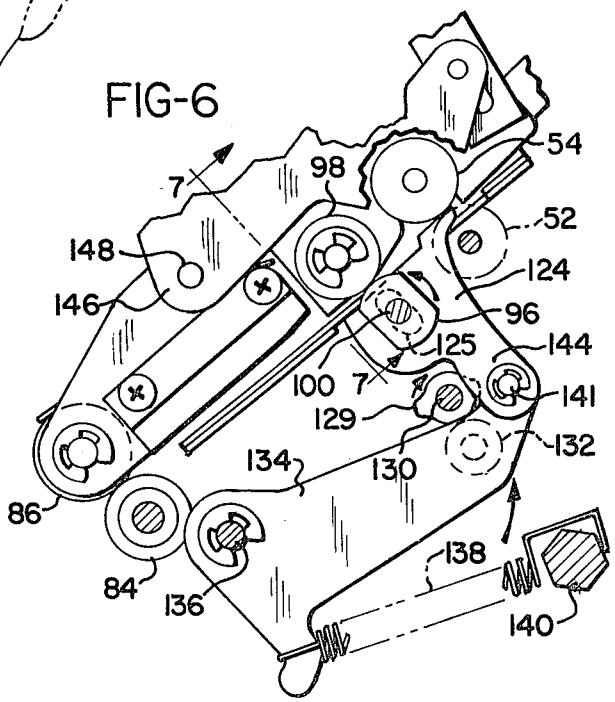
FIG. 6 is a view, similar to FIG. 5, illustrating rotation of the bursting rollers and movement of the gripping member.
Figure 5:
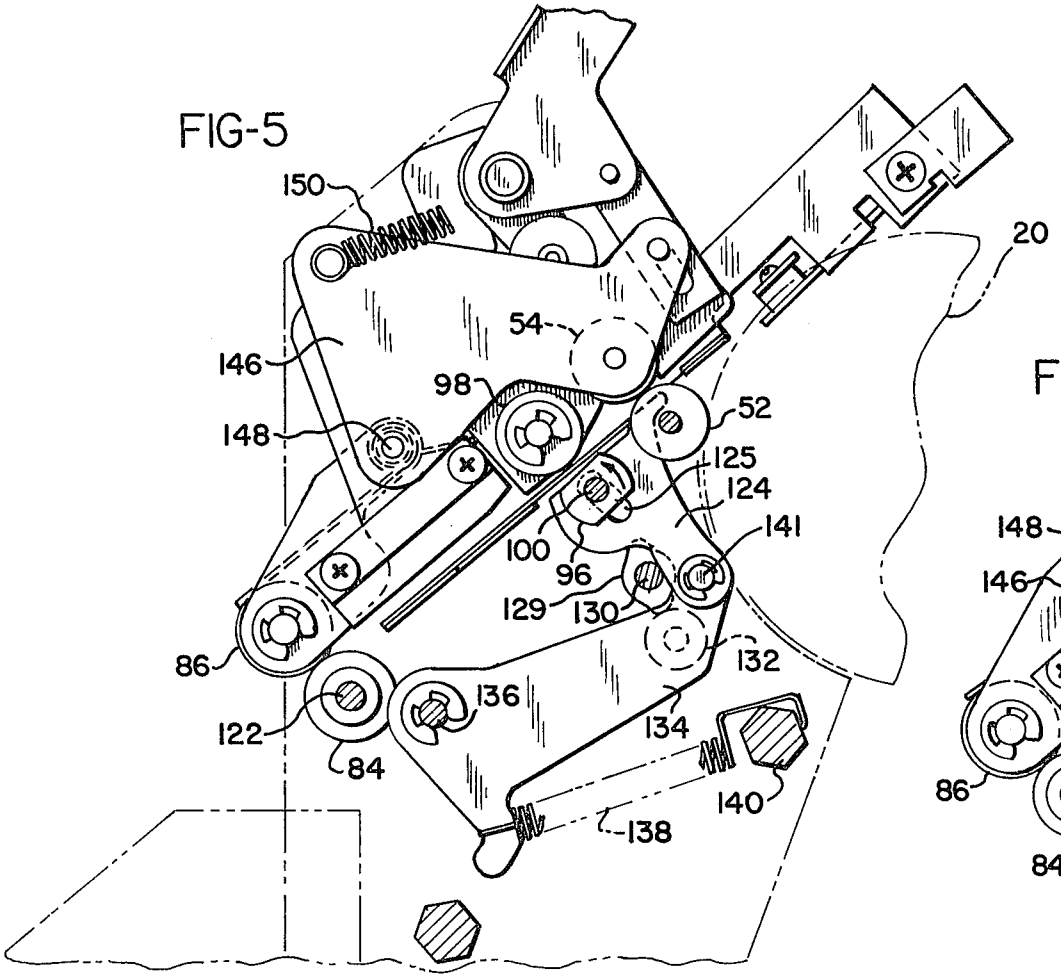
FIG. 5 is an enlarged partial side view, similar to FIG. 3, showing the label tensioning rollers of the printer.

In order to remove the leading end label from the strip of label stock after the label has been printed, label stock bursting rollers 96 and 98 are provided and positioned between the label output 88 and the label tensioning rollers 52 and 54. The label stock bursting rollers 96 and 98 are illustrated in FIGS. 5 and 6 in somewhat greater detail. Rollers 98 are idler rollers, mounted for free rotation, which serve to press each label against rollers 96 during the label bursting operation. Noncircular rollers 96 are mounted for rotation on shaft 100 such that a label is engaged between the bursting rollers only during a portion of each one-half rotation of rollers 96. Shaft 100 carries a gear 102 which engages an intermediate gear 104, as shown in FIG. 4. Gear 104, in turn, engages gear 106 which is mounted on the shaft 108 of clutch 110. Motor 112 continuously drives discharge rollers 84 and 86 by means of belt 114 extending between pulley 116 on motor shaft 118 and pulley 120 on discharge roller shaft 122. Clutch 110 is actuated to rotate shaft 100, however, only when bursting a leading end label from the strip of label stock is desired.

Figure 7:
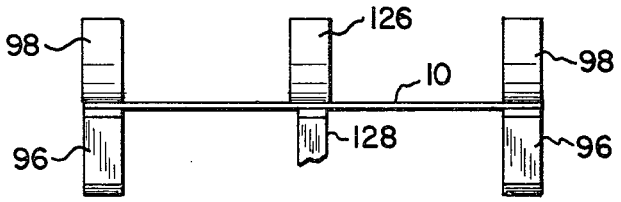
FIG. 7 is a view illustrating the bursting rollers and gripping member, taken generally along line 7—7 in FIG. 6.

Gripping member 124 is mounted on shaft 100 which extends through slot 125. Gripping member 124 is positioned below the label output path and a cooperating roller 126 is mounted above the label output path. Member 124 is movable vertically, as shown in FIG. 6, such that a label may be gripped between portion 128 and roller 126 during bursting of a leading end label from the strip of label stock. A cam 129 is mounted on a shaft 130 which is rotated by gear 104 during the bursting operation. Cam 129 contacts a cam follower roller 132 which is pivotally mounted on arm 134. Arm 134, in turn, is pivotally supported on shaft 136 and is biased in a counterclockwise direction, as seen in FIGS. 5 and 6, by spring 138 which also engages bar 140. Arm 134 pivotally engages member 124 attached to member 124 at 141. As cam 129 is rotated, the arm 134 pivots about shaft 136. As a consequence, member 124 is raised with respect to shaft 100 by virtue of slot 125 such that portion 129 contacts the bottom surface of the next following unprinted label and presses the label against roller 126, as illustrated in FIG. 7.

Figure 8:
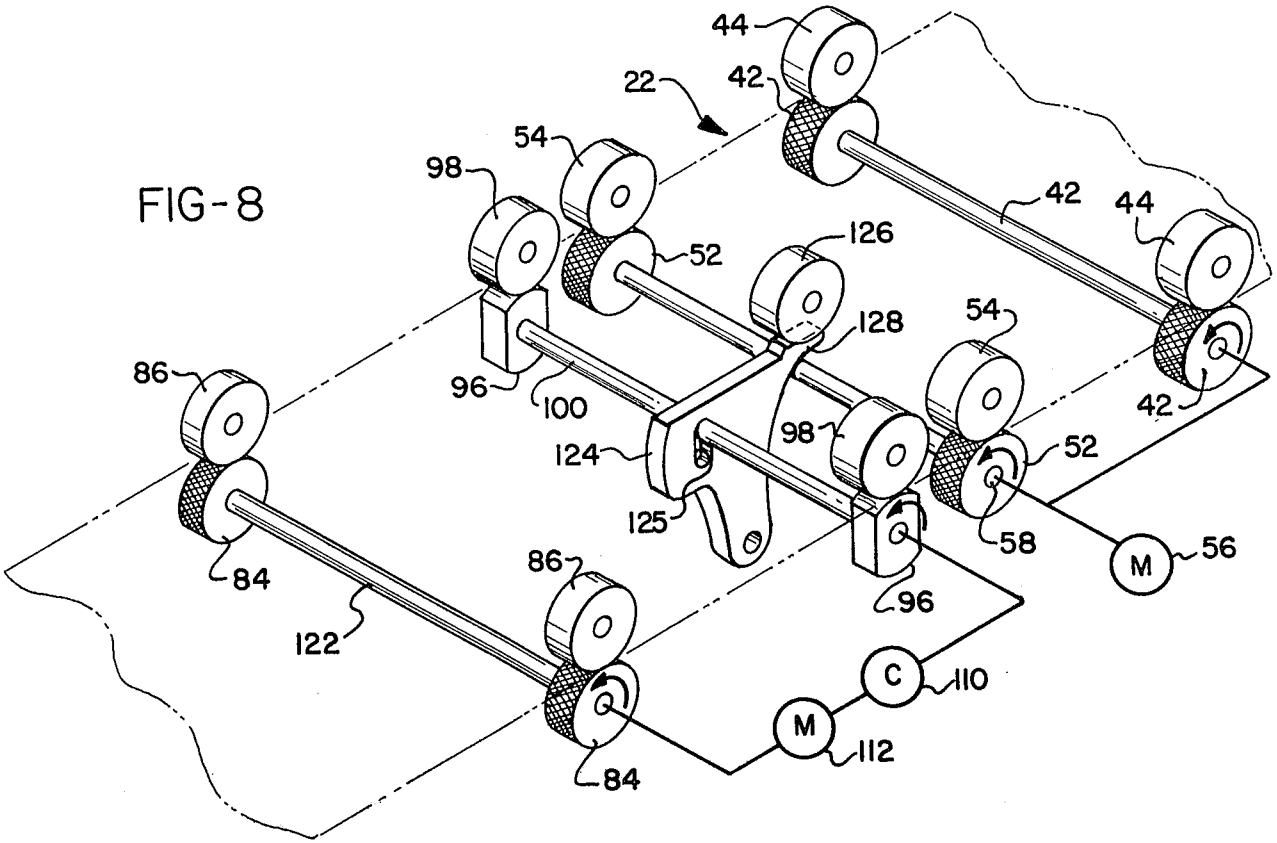
FIG. 8 is an isometric diagrammatic view, illustrating the label path.

The method by which a label is printed and subsequently burst or detached from the strip of label stock may be understood more fully by reference to FIG. 8. The leading label in the strip of label stock is initially advanced only by label advancing rollers 42 and 44 which are driven by stepping motor 56. As the label passes through print station 22, human readable indicia are printed on the downwardly facing print receiving surface of the label. After the label has advanced sufficiently such that its leading edge is also engaged by label tensioning rollers 52 and 54 and the position of the label controlled thereby, the machine readable indicia are printed on the label, as well as any additional human readable indicia.

After the label is printed, the strip of label stock is advanced such that the perforation line between the leading end label and the next following label in the strip is positioned between label tensioning rollers 52 and 54, and label stock bursting rollers 96 and 98. Prior to positioning of the perforation line as indicated, the noncircular rollers 96 are in the position shown in FIG. 5 and, therefore, the leading label is not pinched between rollers 96 and 98. When the perforation line is properly positioned between rollers 52 and 54, and rollers 96 and 98, rotation of rollers 52 and 54 is terminated. Clutch 110 is then actuated to produce a 180° rotation of rollers 96, pulling the leading label free of the strip of label stock along the perforation line.

To enhance this label bursting operation, the gripping member 124 is moved upward such that the central portion of the label following the leading end label is held between portion 128 and roller 126. This ensures that the separation is complete along the entire row of perforations. The detached leading label is then conveyed to the label output 88 by discharge rollers 84 and 86 which are rotated continuously by motor 112.

The 180° rotation of rollers 96 having been completed, clutch 110 is deenergized, and portion 128 of gripping member 124 is moved downwardly out of contact with the label which has now become the leading end label in the strip of label stock. Stepping motor 56 is then reversed so as to rotate rollers 42 and 52 in a clockwise direction, as viewed in FIG. 3, and retract the leading edge of the label stock to a point adjacent the printing station 22 such that this end label may now be printed. Determination of the position of the strip of label stock in the label path may conveniently be made by means of a photocell device (not shown) positioned adjacent the label path which detects the passage of light through the openings 144 (FIGS. 1 and 2) between adjacent labels.

As discussed previously, since the tangential velocity of rollers 42 is less than the tangential velocity of rollers 52, slippage occurs between rollers 42 and a label engaged by both of these rollers simultaneously. In order to assure uniform movement of each label through the printing station 22, the pinching force between rollers 42 and 44 is selected to be less than the pinching force between rollers 52 and 54, with the result that substantially all of the slippage occurs between the label and rollers 42. Rollers 54 are mounted on an arm assemby 146 which is pivotally secured to shaft 148. Spring 150 applies a clockwise movement to arm assembly 146 which provides the downward force, urging rollers 52 and 54 together.

Figure 9:
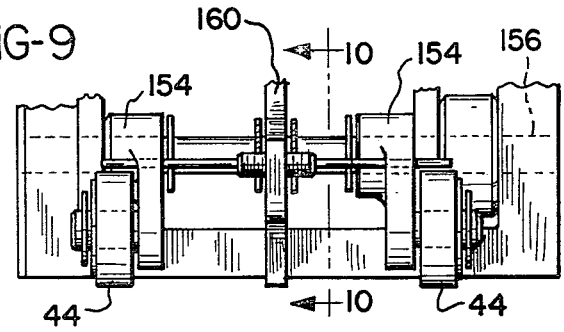
FIG. 9 is a view of the upper label advancing rollers, taken generally along line 9—9 in FIG. 4.
Figure 10:
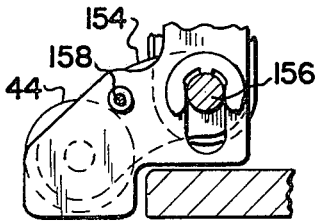
FIG. 10 is a sectional view taken generally along line 10—10 in FIG. 9.

The support arrangement for upper label advancing rollers 44 is illustrated in FIGS. 9 and 10. Each of rollers 44 is rotatably mounted on an arm 154 which, in turn, is pivotally supported on shaft 156. Arms 154 are engaged by a rod 158 which extends through support plate 160, acting as a leaf spring, provides the necessary downward pinching force between rollers 44 and 42. The radius of rollers 42 is only slightly smaller than rollers 52, and as a consequence, very little actual slippage occurs between rollers 42 and a label. Since the position of a label during printing of successive machine readable indicia is controlled by rollers directly connected to the driving motor, there is no play in the roller drive, and print position error for successively printed indicia is minimized.

It will be appreciated that the label printer of the present invention has numerous applications. While this printer has been described with respect to label stock having a heat activated adhesive coating, it will be appreciated that the printer may be utilized with various other types of label stock.

While the form of apparatus herein described constitutes a preferred embodiment of the invention, it is to be understood that the invention is not limited to this precise form of apparatus, and that changes may be made therein without departing from the scope of the invention.

What is claimed is:

1. A label printer for printing both human readable and machine readable indicia on the end label in a strip of perforated label stock, comprising:

printer means, positioned at a print station, for printing both human readable and machine readable indicia on a label transported past said print station, supply means providing a strip of label stock having laterally extending perforation lines spaced along said strip so as to define a plurality of labels, label advancing rollers, between said supply means and said print station, for engaging opposite sides of said label stock and for advancing the label stock through said print station to permit printing on the end label thereof, whereby human readable indicia may be printed on the end label during advancement of said end label past said print station by a predetermined distance, label tensioning rollers, positioned on the opposite side of said print station from said label advancing rollers, for engaging opposite sides of said end label as said label is transported past said print station, said label tensioning rollers being positioned a distance from said print station equal to or less than said predetermined distance, whereby said label stock is engaged by both said label advancing rollers and said label tensioning rollers during printing of the remainder of said end label, whereby machine readable indicia may be printed on the end label while said label is held in tension between said label advancing rollers and said label tensioning rollers, and roller drive means, connected to both said label advancing rollers and said label tensioning rollers, for rotation thereof in synchronization.

2. The label printer of claim 1 in which said roller drive means comprises means for rotating said label advancing rollers and said label tensioning rollers at substantially the same rotational velocity and in which the radius of said label tensioning rollers is greater than the radius of said label advancing rollers, whereby said end label is held in tension during printing of said machine readable indicia thereon.

3. The label printer of claim 1 further comprising means, defining a label output path, for removing printed labels from said printer to a label output, and label stock bursting rollers, positioned between said label output and said label tensioning rollers, for bursting said end label from said strip of label stock.

4. The label printer of claim 3 in which said bursting rollers comprise idler rollers on one side of said strip of label stock, and noncircular rollers on the other side of said strip of label stock, and said printer further comprising means for rotating said noncircular rollers, said noncircular rollers mounted such that a label is engaged between said idler rollers and said noncircular rollers only during a portion of a rotation of said noncircular rollers, whereby rotation of said noncircular rollers while said label tensioning rollers are stationary results in bursting of a label engaged by said bursting rollers.

5. The label printer of claim 4 further comprising a gripping member positioned adjacent said label output path on one side thereof and a cooperating roller on the opposite side of said label output path, and means for moving said member to grip the label adjacent said end label in the central portion thereof between said member and said cooperating roller during bursting of said end label from said strip of label stock.

6. A printer for printing on the end label in a strip of label stock having laterally extending rows of perforations spaced along said strip and defining a plurality of labels, and subsequently bursting the end label from the strip of label stock at the row of perforations separating it from the adjacent trailing label, comprising:

printer means for printing on a label at a print station, means for transporting said end label past a print station for printing on said end label and, thereafter, for positioning said strip with the row of perforations separating said end label from the adjacent trailing label being located at a reference point, strip retarding means, positioned between said reference point and said print station, for engaging said adjacent trailing label near the lateral edges thereof, and restricting further movement thereof, bursting roller means, on the opposite side of said reference point from said strip retarding means, for applying a bursting force to said end label, and means for engaging the central portion of said adjacent trailing label while said strip retarding means restricts movement of said adjacent trailing label, such that bursting of said end label from said strip of label stock is facilitated, said means for engaging the central portion of said adjacent trailing label including a member movable into contact with said adjacent trailing label on the side thereof bearing said printing only when said label is to be engaged.

7. The printer of claim 6 in which said means for engaging the central portion of said adjacent trailing label comprises:

a label engaging member mounted on one side of said strip of label stock, a cooperating roller mounted on the opposite side of said strip, and means for moving said member into contact with said adjacent trailing label to press said label against said cooperating roller, thereby engaging said adjacent trailing label.

8. The printer of claim 6 in which said bursting roller means comprises:

an idler roller on one side of said end label and a noncircular roller on the opposite side of said end label, and means for rotating said noncircular roller so as to engage said end label between said noncircular roller and said idler roller and apply a bursting force thereto.

9. A printer for printing both human readable and machine readable indicia on labels in a strip of label stock as the strip is advanced along a supply path past a print station, comprising:

means providing a supply of label stock, rotatable print drum means mounted at a print station and defining a plurality of raised portions corresponding to human readable and machine readable indicia, means for rotating said print drum means, print hammer means, positioned at said print station on the opposite side of said supply path from said print drum means, for striking said label stock to produce printing thereon by said print drum means, a pair of label advancing rollers, positioned on opposite sides of said supply path between said print station and said label stock supply, for engaging said label stock and transporting said label stock toward said print station, a pair of label tensioning rollers, having a radius slightly greater than that of said label advancing rollers, positioned on the opposite side of said print station from said label advancing rollers, said label tensioning rollers being positioned on opposite sides of said supply path for engaging said label stock, means for rotating said label advancing rollers and said label tensioning rollers at substantially the same angular velocity, whereby the tangential velocity of said label tensioning rollers is slightly greater than the tangential velocity of said label advancing rollers and said label stock is maintained in tension at said print station, and means for providing a substantially larger stock engaging force between said pair of label tensioning rollers than between said pair of label advancing rollers, whereby slippage occurs between said pair of label advancing rollers and said label stock.

10. A label printer for printing at a print station both human readable and machine readable bar code indicia over a substantial portion of the end label in a strip of perforated label stock, comprising:

supply means providing a strip of label stock having laterally extending perforation lines spaced along said strip and defining a plurality of labels, each of which is to be separated from said strip after printing, label advancing and retracting rollers, between said supply means and said print station, for engaging opposite sides of said label stock to advance the label stock through said print station during printing of the end label thereof and to retract the stock after the end label has been separated from said strip, thereby presenting the next following label in position for printing close to its leading edge, label tensioning rollers, positioned on the opposite side of said print station from said label advancing rollers, for engaging opposite sides of said end label after said label has been partially printed and while it is being transported through said print station, printer means for printing only human readable indicia on said end label during travel of its leading edge from said print station to said label tensioning rollers, and for printing said machine readable bar code indicia on said end label only after the label is engaged by said label tensioning rollers, and roller drive means for rotating all of said rollers, said label tensioning rollers being rotated at a tangential velocity greater than that of said label advancing and retracting rollers, thereby maintaining said end label under tension during printing of said machine readable bar code indicia thereon.

11. The label printer of claim 10 in which said roller drive means comprises means for rotating said label advancing and retracting rollers and said label tensioning rollers at substantially the same rotational velocity, and in which the radius of said label tensioning rollers is greater than the radius of said label advancing and retracting rollers, whereby said end label is held in tension during printing of said machine readable indicia thereon.

12. The label printer of claim 10 further comprising means, defining a label output path, for removing printed labels from said printer to a label output, and label stock bursting rollers, positioned between said label output and said label tensioning rollers, for bursting said end label from said strip of label stock.

13. The label printer of claim 12 in which said bursting rollers comprise idler rollers on one side of said strip of label stock and noncircular rollers on the other side of said strip of label stock, and said printer further comprising means for rotating said noncircular rollers, said noncircular rollers mounted such that said end label is engaged between said idler rollers and said noncircular rollers only during a portion of each rotation of said noncircular rollers, whereby rotation of said noncircular rollers while said label tensioning rollers are stationary results in bursting of a label engaged by said bursting rollers.

14. The label printer of claim 13 further comprising a gripping member positioned adjacent said label output path on one side thereof and a cooperating roller on the opposite side of said label output path, and means for moving said member to grip the label adjacent said end label in the central portion thereof between said member and said cooperating roller during bursting of said end label from said strip of label stock.

15. The label printer of claim 10 further comprising means for providing a substantially larger stock engaging force between said label tensioning rollers than between said label advancing and retracting rollers, whereby slippage occurs between said label advancing and retracting rollers and said label stock.

* * * * *